United States Patent [19]

Furukawa

[11] Patent Number: 4,753,060

[45] Date of Patent: Jun. 28, 1988

[54] METHOD AND APPARATUS FOR FILLING BAGS

[75] Inventor: Takao Furukawa, Onomichi, Japan

[73] Assignees: ECS Corporation, Hiroshima; Furukawa Mfg. Co., Ltd., Tokyo, both of Japan

[21] Appl. No.: 64,399

[22] Filed: Jun. 22, 1987

[30] Foreign Application Priority Data

Dec. 20, 1986 [JP] Japan ..... 61-304803

[51] Int. Cl.[4] ..... B65B 43/18

[52] U.S. Cl. ..... 53/459; 53/469; 53/573; 53/579

[58] Field of Search ..... 53/459, 469, 573, 563, 53/585, 292, 385, 469, 579

[56] References Cited

U.S. PATENT DOCUMENTS

| | | | |
|---|---|---|---|
| 2,036,105 | 3/1936 | Strout | 53/292 |
| 2,182,187 | 12/1939 | Wagner | 53/573 X |
| 2,732,115 | 1/1956 | Allen | 53/292 |
| 2,834,166 | 5/1958 | Fogwell | 53/573 X |
| 2,950,589 | 8/1960 | Litchard | 53/573 |
| 2,976,661 | 3/1961 | Bagnelle | 53/585 X |
| 3,566,578 | 3/1971 | Thorne | 53/573 X |

*Primary Examiner*—John Sipos

*Attorney, Agent, or Firm*—Barnes, Kisselle, Raisch, Choate, Whittemore & Hulbert

[57] ABSTRACT

When filling flexible bags with a specified quantity of material, the uppermost one of the bags is opened at the mouth thereof and a spatular element is inserted into the bag while streams of gas are discharged from the surface of the element. Then, a vacuum suction force is applied to the surface of the spatular element to cause the bag to be sucked to that surface so that the bag, together with the element, is moved into a recessed wall of a stand frame. The bag is inflated in the recessed wall by discharging jets of gas from the surface of the spatular element into the bag, and simultaneously the bag is sucked to the inner surface of the recessed wall under a vacuum suction force while being held in opened condition. Subsequently, the specified quantity of material is filled into the bag. In this way, each flexible bag is moved to the stand frame while being accurately sucked to and kept in the spatular element. The bag can also be accurately held in opened condition while being sucked to the inner surface of the recessed wall. Thus, any desired material can be filled into the flexible bag without any filling error.

6 Claims, 3 Drawing Sheets

METHOD AND APPARATUS FOR FILLING BAGS

FIELD OF THE INVENTION

This invention relates to a method and apparatus for filling a multiplicity of flexible bags, stacked up in flat condition, with a specified quantity of material wherein the bags are picked up one by one, beginning with the uppermost one, and moved to a stand frame, in which each of the bags is longitudinally supported and opened at the mouth thereof so that the material is filled into the bag through the mouth so opened.

BACKGROUND OF THE INVENTION

Known packaging apparatuses for packaging in bags a material in the form of liquid, powder, or particulate solid are typically such that each bag is first longitudinally supported, then opened at the mouth thereof, through which the material is filled into the bag. In packaging operations employing such apparatus, it is a usual practice that since the bags, being flexible and limp, cannot be placed upright in a bag loading box for housing the bags, the bags are stacked up in flat condition in the loading box so that they are picked up one by one, beginning with the uppermost one, each bag being longitudinally oriented in the course of transport thereof for being supplied to the packaging apparatus. U.S. Pat. No. 3,945,173 discloses an apparatus wherein bags placed flat on a stack are picked up one by one, beginning with the uppermost one, through suction by a suction cup, each bag so picked up being fed between a pair of clamps, which in turn engage the opposite sides of the bag adjacent the mouth thereof; then the mouth of the bag is opened by two suction cups and fitted around an outlet end of a hopper for filling a specified quantity of material into the bag as a pair of clamp arms rotate.

With the apparatus of U.S. Pat. No. 3,945,173, however, one difficulty is that when the bags piled up are picked up one by one through suction by the suction cup, it may occasionally happen that some bag is not properly picked up by the suction cup, because static electricity may occur among the bags. Another difficulty is that when a bag is being transported by the suction cup to the space between the pair of clamps, it may sometimes happen that the mouth of the bag becomes open to allow the entry of air thereinto, with the result of the bag dropping from the suction cup because the load of the bag becomes larger due to air resistance. In the latter mentioned case, if the bag does not drop from the suction cup, it may not be accurately clamped at opposite sides thereof near the bag mouth because the bag is fed and held in an incomplete position between the pair of clamps.

Another type of packaging apparatus is known, such as one disclosed in U.S. Pat. No. 4,027,456, wherein bags piled up in flat condition in a box are taken out one by one through roller movement, beginning with the lowermost bag, so that each bag is supplied between a pair of clamps. Such packaging apparatus has a difficulty that the lowermost bag in the box is subject to the influence of the load of many bags placed thereon and, therefore, that if the bags are of a thin and soft material, it is impracticable to take out one bag each against the friction resistance from and between individual bags thereon.

With any such prior art packaging apparatus as described above, therefore, some 2–4% packaging errors have been unavoidable if the bags to be filled were of a thin and flexible material.

SUMMARY OF THE INVENTION

Accordingly, the primary object of this invention is to provide a method of filling flexible bags which allows each bag to be accurately opened at the mouth thereof so that the bag is filled free of the slightest packaging error.

In order to accomplish this object, the method of filling bags in accordance with the invention comprises:

opening the mouth of the uppermost one of a plurality of bags stacked up in flat condition, through suction by a suction cup, inserting into the bag through the opened bag mouth a spatulate element of a hollow structure having a multiplicity of breathing holes formed thereon while causing streams of gas to jet out of said breathing holes, then applying a vacuum suction force inwardly from the exterior side of said breathing holes so as to cause the bag to be sucked onto the spaculate element, moving with the spatulate element the bag sucked thereonto to a stand frame opening at the top and having a recessed wall which is configured similarly to an inflated bag and formed with a multiplicity of vent holes, and inserting the bag into said stand frame in conjunction with the spatulate element, subsequently, withdrawing the spatulate element from the bag while allowing the bag to be inflated within the stand frame by streams of gas jetted out from the breathing holes of the spatulate element, and applying a vacuum suction force on the outer periphery of said recessed wall of the stand frame, thereby causing the bag to be sucked in opened condition onto the vent holes of the recessed wall, then filling a specified quantity of material into the bag through the opened mouth thereof.

According to such method of the invention, the spatulate element is inserted into each bag through the mouth thereof opened by the suction cup while streams of gas are discharged from the spatulated element. This minimizes the friction resistance of the spatulate element and the bag to each other and thus permits smooth insertion of the spatulate element into the bag. The bag is transported to the stand frame while being sucked onto the spatulate element by the sucking action of the breathing holes bored in the spatulate element, and thus there is no possibility of the bag dropping off the spatulate element. The bag is inflated within the stand frame under the pressure of the gas streams jetting out from the breathing holes of the spatulate element and is sucked against the recessed wall of the stand frame through a suction force. This allows the bag to be firmly held in opened condition, and therefore the bag is unlikely to drop under the weight of the material loaded therein in the course of the bag being filled. Thus, all possible feed errors, mouth opening errors, and holding errors are eliminated.

DESCRIPTION OF THE PREFERRED EMBODIMENT

One embodiment of the invention will now be described in detail with reference to the drawings.

Figure 1:
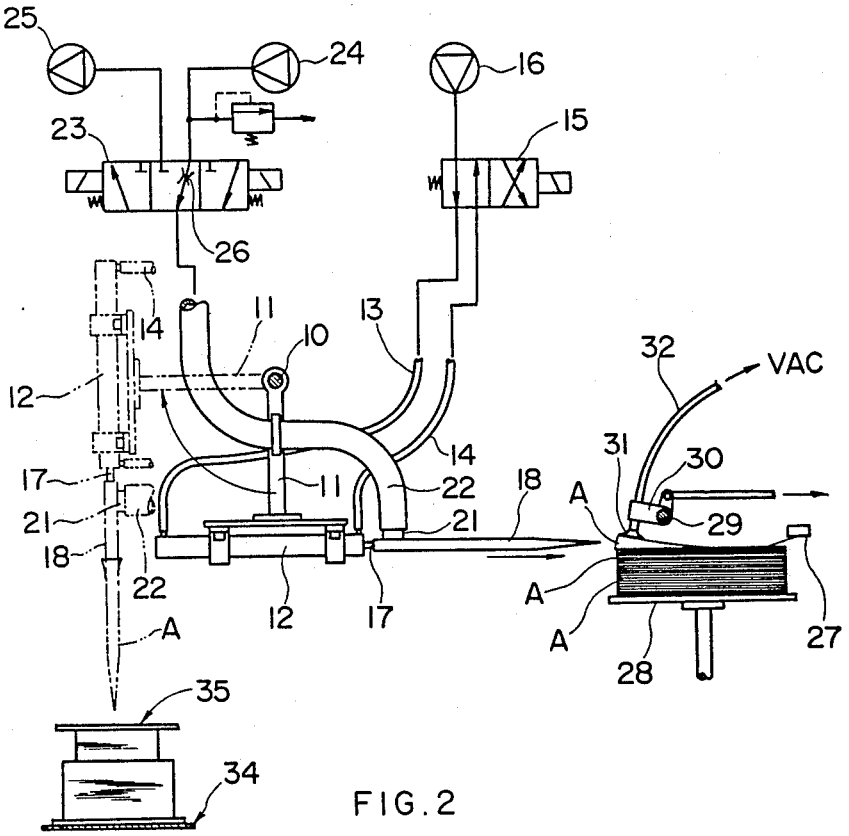
FIG. 1 is a front view showing an apparatus for carrying out the method of the invention.

In FIG. 1, a shaft 10 which is forward and reverse rotatable within an angular range of 90 degree has an arm 11 fixed at one end thereto, said arm 11 being fixed at the other end to an air cylinder 12 in perpendicular relation thereto. The air cylinder 12 has two chambers defined therein across a piston, said two chambers being connected respectively through flexible tubes 13, 14 to a first compressor 16 via a two-position, four-port type changeover valve 15. A spatulate element 18 is fixed to one end of the piston rod 17 of the air cylinder 12.

Figure 3:
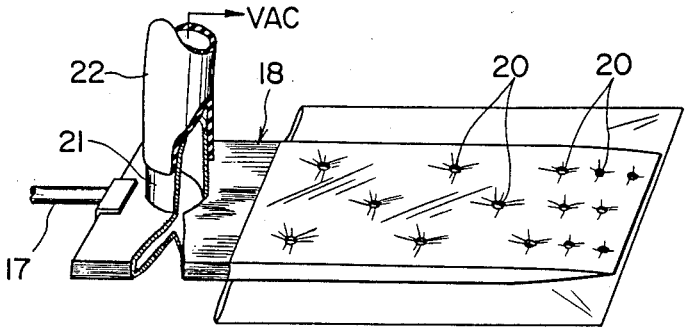
FIG. 3 is a perspective view of a spatulate element in FIG. 1.

As shown in FIG. 3, the spatulate element 18 consists of a thin lamellar structure having a certain width, said spatulate element 18 being sharpened thicknesswise at the front end thereof and having a hollow interior. The spatulate element 18 has a multiplicity of breathing holes 20, 20 open on both sides thereof over an area extending forward from a mid portion thereof. A socket 21 is provided at the base end of the spatulate element 18 for communication with said hollow portion, there being a hose 22 connected at one end to said socket 21.

As shown in FIG. 1, the other end of the hose 22 is connected to both a second compressor 24 and a vacuum pump 25 through a three-position, three-port type electromagnetic changeover valve 23. At a center position of the three-position, three-port type changeover valve 23 there is provided a restrictor 26 in a passage, so that the flow of the gas from the second compressor 24 is restricted by the restrictor 26 prior to the gas being discharged from the breathing holes 20, 20 . . . of the spatulate element 18.

In front of the forward end of the spatulate element 18 there is provided a platform 28 on which a multiplicity of bags A, A . . . are placed one over another in flat condition, said platform 28 being constantly urged upward by a biasing force regulated by a switch 27 so that the top level of the bags A is maintained constant. At a level above the mouth of the uppermost bag A there is supported a suction cup 31 by a shaft 29 through a lever 30, said suction cup 31 being connected to a source of vacuum through a tube 32.

As the lever 30 is rotated forward and reverse by the shaft 29, the suction cup 31 is moved upward and downward under a predetermined cycle. When the suction cup 31 is moved upward, it lifts the mouth edge portion of the uppermost one of the bags A, thereby opening the bag mouth. Thereupon, the changeover valve 15 is switched over, whereby the discharge pressure from the first compressor 16 is applied to the air cylinder 12 so that the spatulate element 18 is inserted into the bag A through the opened mouth thereof. In this case, the discharge gas from the second compressor 24 jets out in streams from the breathing holes 20 of the spatulate element 18 under flow restriction by the restrictor 26; therefore, the bag A is inflated to a certain extent so that the spatulate element 18 is inserted into the bag A without resistance. After the spatulate element 18 having been inserted into the bag, the electromagnetic changeover valve 23 is switched over. Thereupon, a suction force from the vacuum pump 25 acts on the breathing holes 20, 20 . . . of the spatulate element 18 so that the bag A is sucked to the spatulate element 18.

Then, the changeover valve 15 is switched over and the spatulate element 18 is pulled back, as it supports the bag A in position, by a discharge pressure from the first compressor 16. Thereupon, the shaft 10 rotates 90 degree so that the air cylinder 12 is moved to a position shown by virtual lines in FIG. 1, thereby causing the bag A supported on the spatulate element 18 to hang down toward a stand frame 35 on a belt conveyor 34.

Figure 2:
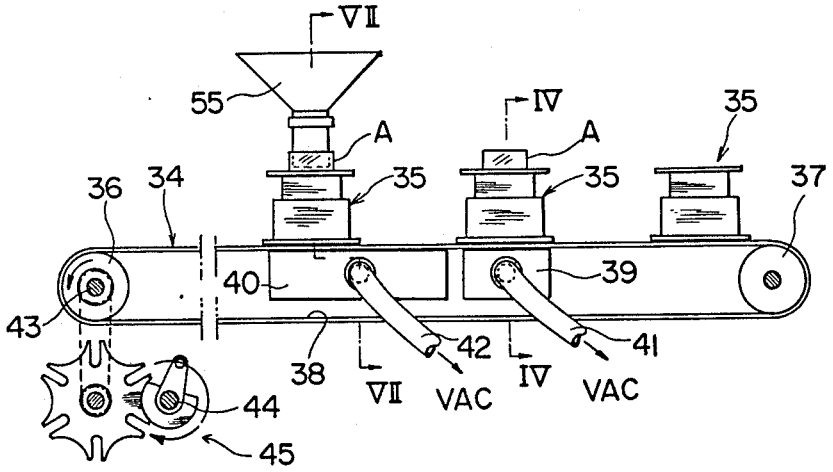
FIG. 2 is a side view of a conveyor belt in the apparatus.

As shown in FIG. 2, the belt conveyor 34 comprises an endless belt 38 trained around a pair of pulleys 36, 37, with two vaccum cans 39,40 disposed on the underside of the belt 38, said vacuum cans 39,40 communicating with the vacuum source through hoses 41, 42. A shaft 43 of said pulley 36 is connected to a driver shaft 44 through a Geneva stop 45.

Figure 4:
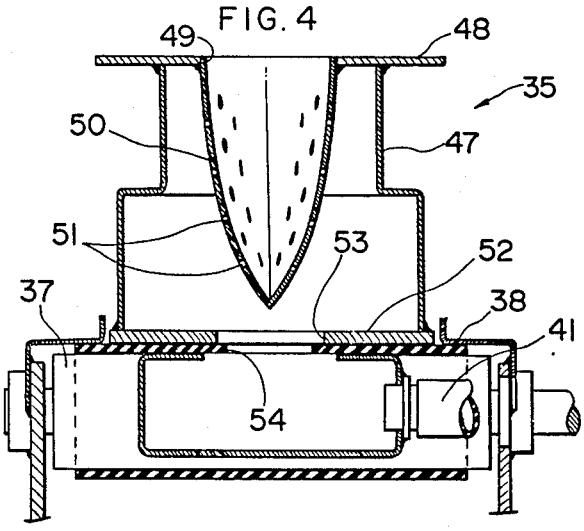
FIG. 4 is a view showing a sectional configuration of a stand frame, cut away along the line IV—IV in FIG. 2.
Figure 5:
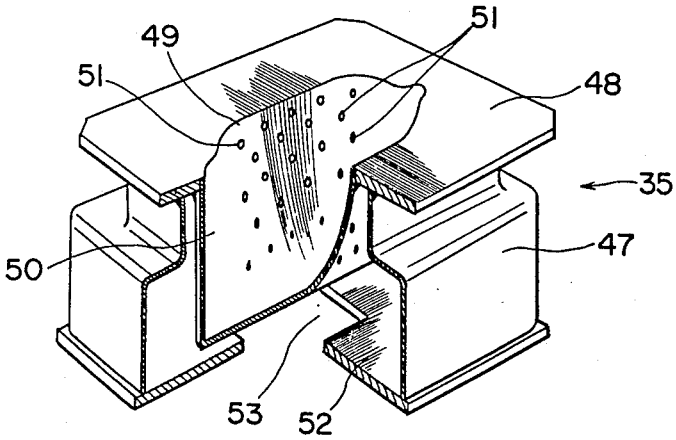
FIG. 5 is a partially cutaway view in perspective of the stand frame in FIG. 4.

The stand frame 35, as can be seen from FIGS. 4 and 5, comprises an outer casing 47, a board 48 fixed on the top thereof and having an oblong hole 49 bored therein, a recessed wall 50 provided in said hole 49 and having a configuration resembling to an inflated bag 50, said recessed wall 50 having a multiplicity of vent holes 51, 51 . . . open therethrough, a vacuum suction hole 53 opening centrally in a bottom plate 52 of the casing 47. The endless belt 38 of the belt conveyor 34 has equispaced vent holes 54 bored therein.

As can be understood from FIG. 2, when the stand frame 35 is placed on the belt conveyor 34 at one end thereof, the stand frame 35 is moved to a position right above the vacuum can 39 through intermittent rotation of the Geneva stop 45 and stopped there. In this conjunction, as shown in FIG. 4 the stand frame 35 is so placed that the vacuum suction hole 53 in the bottom plate 52 of the stand frame 35 is in agreement with one of the vent holes 54 in the belt; therefore, when the stand frame 35 reaches said position on the vacuum can 39, a suction force is applied from within the individual vent holes 51, 51 of the recessed wall 50 toward the interior of the casing 47.

Figure 6:
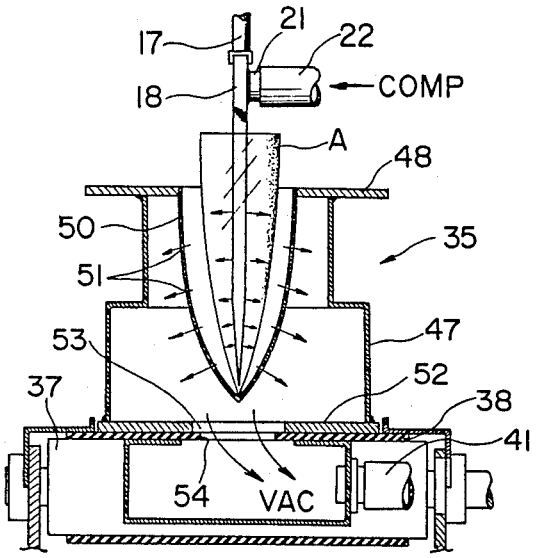
FIG. 6 is a sectional view of the stand frame in FIG. 4, as it appears when the spatulate element, integrally with a bag, is inserted into the stand frame.

Concurrently, the discharge pressure from the first compressor 16 in FIG. 1 is delivered to the air cylinder 12 in the condition shown by the virtual lines so that the bag A is inserted into the recessed wall 50 of the stand frame 35. Thereupon, the electromagnetic changeover valve 23 is switched over, whereby the discharge pressure from the second compressor 24 is applied to the interior of the bag A so that the bag A is inflated as shown in FIG. 6. Simultaneously, the bag A is sucked to the inner surface of the recessed wall 50.

Figure 7:
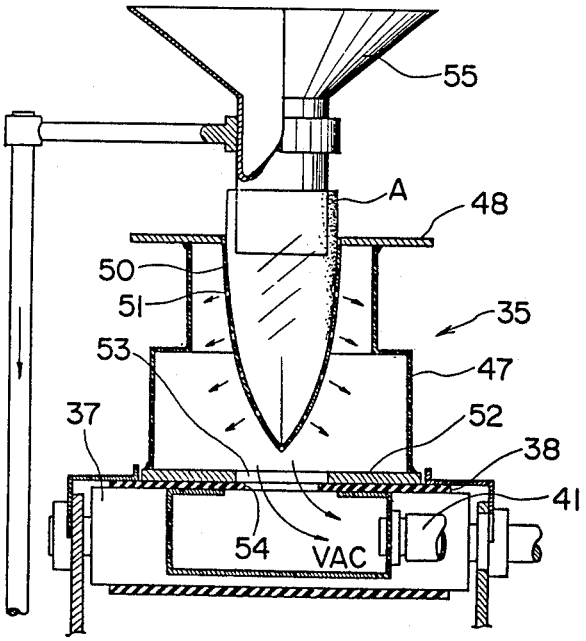
FIG. 7 is a section taken along the line VII—VII in FIG. 2.

When the spatulate element 18 is released from the bag A through the action of the air cylinder 12, the belt conveyor 34 in FIG. 2 is actuated to move the stand frame 35 to a position above the rear vacuum can 40. Then, the vacuum can 40 causes the bag A to be sucked to the inner surface of the recessed wall 50 so that the bag A is still kept open as it is. As shown in FIGS. 2 and 7, a hopper 55 is now inserted into the opened mouth of the bag A so that a specified amount of material is filled into the bag A through the hopper 55.

Subsequently, the stand frame 35 is moved toward a sealing mechanism, by which the mouth edge of the bag A is sealed.

It is noted that a chamber may be placed on the board 48 of the stand frame so that the mouth edge portion of the bag A is sealed in the chamber while vacuum is applied to the material in the bag A.

What is claimed is:

1. A method of filling flexible bags comprising:

opening the mouth of the uppermost one of a plurality of the flexible bags stacked up in flat condition, through suction by a suction cup, inserting into the bag through the opened bag mouth a spatulate element of a hollow structure having a multiplicity of breathing holes formed thereon while causing relatively feeble streams of gas to jet out of said breathing holes, then applying a vacuum suction force inwardly from the exterior side of said breathing holes so as to cause the bag to be sucked onto the spatulate element, moving with the spatulate element the bag sucked thereonto to a stand frame opening at the top and having a recessed wall which is configured similarly to an inflated bag and formed with a multiplicity of vent holes, and inserting the bag into said stand frame in conjunction with the spatulate element, subsequently, withdrawing the spatulate element from the bag while allowing the bag to be inflated within the stand frame by relatively vigorous streams of gas jetted out from the breathing holes of the spatulate element, and applying a vacuum suction force on the outer periphery of said recessed wall of the stand frame, thereby causing the bag to be sucked in opened condition onto the vent holes of the recessed wall, then filling a specified quantity of material into the bag through the opened mouth thereof.

2. An apparatus for filling flexible bags comprising:

opening means for opening the mouth of the uppermost one of a plurality of the flexible bags stacked up in flat condition, a spatulate element of a hollow structure having a multiplicity of breathing holes formed thereon and insertable into the bag through the opened bag mouth, a pressure source for supplying gas to the spatulate element to cause relatively feeble streams of the gas to be jetted out from the breathing holes while the spatulate element is inserted into the bag, a vacuum source for applying a vacuum suction force inwardly from the exterior side of the breathing holes so as to cause the bag to be sucked onto the spatulate element after the insertion of the spatulate element, a stand frame opening at the top and having a recessed wall which is configured similarly to an inflated bag and formed with a multiplicity of vent holes, moving means for moving the spatulate element with the bag sucked thereon to the stand frame, and for subsequently withdrawing the spatulate element without the bag from said stand frame, said pressure source being operative to supply gas to the spatulate element to cause relatively vigorous streams of the gas to be jetted out from the breathing holes of the spatulate element so as to cause the bag to be inflated within the stand frame, means for applying a second vacuum suction force on the outer periphery of the recessed wall of the stand frame so as to cause the bag to be sucked in opened condition onto the vent holes of the recessed wall and allow the moving means to withdraw the spatulate element without the bag from the stand frame as aforesaid, and filling means for filling a specified quantity of material into the bag sucked onto the vent holes through the opened mouth of the bag.

3. An apparatus as set forth in claim 2, wherein the spatulate element is internally selectively connectable to the vacuum source or the pressure source and is mounted to the extendable/contractable end of a cylinder device.

4. An apparatus as set forth in claim 3, wherein the spatulate element is connected to both the vacuum source and the pressure source through a three-position changeover valve, the changeover valve having a first position wherein the spatulate element is connectable to the pressure soure to cause the vigorous streams of the gas, a second position wherein the spatulate element is connectable to the vacuum source to cause the bag to be sucked onto the spatulate element, and a third position wherein the spatulate element is connectable to the pressure source and there is provided a restrictor in a passage so as to restrict the flow of the gas from the pressure source to cause the feeble streams.

5. An apparatus as set forth in claim 3, wherein the cylinder device is movable between a position adjacent the plurality of the flexible bags placed one over another in flat condition and a position right above the opening of the recessed wall of the stand frame.

6. An apparatus as set forth in claim 2, wherein the outer periphery of the recessed wall is enclosed by a casing, the space between the recessed wall and the casing being connectable to a second vacuum source.

* * * * *